US010808440B2

(12) United States Patent
Tiilikainen et al.

(10) Patent No.: US 10,808,440 B2
(45) Date of Patent: Oct. 20, 2020

(54) DOOR, CLOSING SYSTEM AND LOGISTICS CONTAINER

(71) Applicant: K. Hartwall Oy Ab, Söderkulla (FI)

(72) Inventors: Markku Tiilikainen, Söderkulla (FI); Mikko Järvi, Söderkulla (FI)

(73) Assignee: K. Hartwall Oy Ab, Soderkulla (FI)

( * ) Notice: Subject to any disclaimer, the term of this patent is extended or adjusted under 35 U.S.C. 154(b) by 0 days.

(21) Appl. No.: 15/801,011

(22) Filed: Nov. 1, 2017

(65) Prior Publication Data

US 2018/0119464 A1 May 3, 2018

(30) Foreign Application Priority Data

Nov. 2, 2016 (FI) ..... 20165824

(51) Int. Cl.

| | |
|---|---|
| ***E05B 81/00*** | (2014.01) |
| ***E05C 19/18*** | (2006.01) |
| ***E05C 1/04*** | (2006.01) |
| ***E05C 1/10*** | (2006.01) |
| ***E05C 3/00*** | (2006.01) |
| *E05C 3/02* | (2006.01) |
| *E05C 1/00* | (2006.01) |

(52) U.S. Cl.

CPC ..... *E05C 19/184* (2013.01); *E05C 1/04* (2013.01); *E05C 1/10* (2013.01); *E05C 3/002* (2013.01); *E05C 2001/008* (2013.01); *Y10S 292/29* (2013.01); *Y10T 292/0894* (2015.04); *Y10T 292/432* (2015.04); *Y10T 292/438* (2015.04)

(58) Field of Classification Search

CPC ..... Y10T 292/0894; Y10T 292/0895; Y10T 292/09; Y10T 292/0901; Y10T 292/096; Y10T 292/1014; Y10T 292/1028; Y10T 292/103; Y10T 292/23; Y10T 292/34; Y10T 292/379; Y10T 292/432; Y10T 292/438; E05C 3/002; E05C 19/184; Y10S 292/29

See application file for complete search history.

(56) References Cited

U.S. PATENT DOCUMENTS 43,145 A * 6/1864 Warner ..... E05C 1/04 292/152
234,614 A * 11/1880 Riggs ..... B62D 33/0273 296/53

(Continued)

FOREIGN PATENT DOCUMENTS

GB 108958 A 8/1917
GB 812585 A * 4/1959 ..... E05C 19/184

*Primary Examiner* — Carlos Lugo
(74) *Attorney, Agent, or Firm* — Chernoff, Vilhauer, McClung & Stenzel, LLP

(57) ABSTRACT

A safe and user-friendly door, especially for logistics containers, which preferably includes a quadrilateral frame, defining the perimeter for the door. A latch is provided movably to the frame so as to be manipulated between a locking state, in which at least a distal portion of the latch protrudes outside the perimeter, and a released state, in which the distal portion is flush with or inside the perimeter. The frame also preferably includes a diagonal guide, which is configured to guide the latch between the locking state and the released state by allowing deviation of the latch along a path diagonal to the quadrilateral shape of the frame.

13 Claims, 6 Drawing Sheets

(56) References Cited

U.S. PATENT DOCUMENTS 315,978 A * 4/1885 Turner ..... E05B 65/025 292/188
442,646 A * 12/1890 Songer ..... E05C 9/043 292/36
548,692 A * 10/1895 Zweig ..... E05C 19/06 292/19
589,921 A * 9/1897 Ashworth ..... A24F 27/00 206/121
701,884 A * 6/1902 Hon ..... B62D 33/0273 160/217
720,496 A * 2/1903 Patton ..... E05B 15/0053 292/156
727,139 A * 5/1903 Heston ..... E05C 9/043 292/36
777,686 A * 12/1904 Moore ..... E05C 1/04 292/147
846,804 A * 3/1907 Patton ..... E05C 9/043 292/36
1,077,433 A * 11/1913 Schlis ..... E05B 59/00 292/40
1,374,878 A * 4/1921 Childers ..... E05B 65/0007 292/150
1,485,301 A 2/1924 Gorge
1,570,072 A * 1/1926 Merz ..... E05D 13/06 292/145
1,570,603 A * 1/1926 Holda ..... E05B 65/0007 292/150
1,574,222 A * 2/1926 Wensel ..... E05C 1/04 292/145
1,632,832 A * 6/1927 Gold ..... E05C 1/04 292/152
1,701,429 A * 2/1929 Thompson ..... E05B 65/0007 292/332
2,065,878 A * 12/1936 Wurzlow ..... B65F 1/1615 292/137
2,247,556 A * 7/1941 Lazarides ..... E05C 1/04 292/152
2,390,731 A 12/1945 Oxhandler
2,759,752 A * 8/1956 Demings ..... E05C 1/16 292/173
4,214,783 A * 7/1980 Boegeman ..... E05C 1/04 292/148
4,673,202 A 6/1987 Willis
4,993,757 A * 2/1991 Corzine ..... E05B 47/0002 292/144
5,076,621 A * 12/1991 Taylor ..... E05C 1/04 292/183
5,327,632 A * 7/1994 Moore ..... E05B 13/002 29/401.1
5,588,318 A * 12/1996 Osborne ..... E05B 47/0002 292/144
5,836,625 A * 11/1998 Kibble ..... E05B 15/0053 292/145
7,066,502 B1 * 6/2006 Makus ..... A01K 1/0017 292/139

* cited by examiner

DOOR, CLOSING SYSTEM AND LOGISTICS CONTAINER

CROSS-REFERENCE TO RELATED APPLICATIONS

This application claims priority under 35 U.S.C. § 119 to Finnish Patent Application No. 20165824 filed Nov. 2, 2016.

FIELD

The present disclosure relates to logistics equipment. In particular, the invention relates to containers for transporting parceled goods.

BACKGROUND OF THE INVENTION

Before delivery to the recipient, most items are transported in consolidated units. There are known a vast variety of containers for facilitating such bulk transports. In mail logistics at least, roll containers are the de facto solution for transporting letters and packages between and within hubs before the parcel is delivered to the recipient. Conventional containers include three fixed wall sections and a door, which covers the fourth lateral side of the container. Both the fixed wall sections and the door feature a peripheral frame surrounding a mesh tight enough to safely keep all contents within the container. A problem associated with conventional roll containers is that when the design of the door, or more generally the closing system, is a trade-off between security and usability. By adding sturdy closing mechanisms to the container, the usability is compromised because the operator must manipulate several locks, latches, etc. to open or close the door.

It is therefore an aim of the present proposal to introduce a solution that would not only close the container in a safe way but also be very useable.

SUMMARY OF THE INVENTION

A novel proposition is herein presented for providing a safe and user-friendly way of closing containers, especially logistics containers.

Firstly, a novel door is presented, which includes a quadrilateral frame, which defining the perimeter for the door. The frame has a diagonal guide which extends diagonally inside the perimeter of the door and which has an inner cavity. A latch has a first projection which is provided movably into the inner cavity of the diagonal guide of the frame so as to be manipulated between a locking state, in which at least a distal portion of the latch protrudes outside said perimeter, and a released state, in which the distal portion is flush with or inside said perimeter. The diagonal guide guides the latch between the locking state and the released state by allowing deviation of the latch along a path diagonal to the quadrilateral shape of the frame. The door is equipped with a holding mechanism for holding the latch in the released state or locking state or selectively both. The holding mechanism has an opening provided to the diagonal guide and a holding protrusion provided to the first projection of the latch. The holding protrusion may be deviated in a dimension perpendicular to the main extending dimension of the first projection for releasably engaging the opening, when the latch is in the released state.

Secondly, a novel closing system is presented including a first door jamb with a first catch, a second door jamb provided at a distance from the first door jamb, and a door as described above. The door is hinged to the second door jamb so as to be turned between a closed state and an open state. The door includes a quadrilateral frame defining a perimeter for the door. The door frame has a diagonal guide which is configured to guide a latch between the locking state and the released state by deviating the latch along a path diagonal to the quadrilateral shape of the frame. The door also includes a corresponding latch provided to the frame so as to be manipulated between a locking state, in which at least a distal portion of the latch protrudes into the first catch of the first door jamb, and a released state, in which the distal portion is outside of the first catch of the first door jamb. The frame of the door includes a diagonal guide, which guides the latch between the locking state and the released state by deviating the latch along a path diagonal to the quadrilateral shape of the frame.

Thirdly, a novel logistics container is presented including a closing system as described above. The first jamb of the system is a frame beam of a first side wall of the logistics container and the second jamb is a frame beam of second side wall opposing the first side wall.

Considerable benefits are gained with aid of the novel design. Because the latch is guided on a diagonal track, the vertical component of the guide provides a natural bias towards the closed state. The design also enables multiple locking points between the door and the jamb. Further benefits of the novel design will become apparent in connection with particular embodiments described here after.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

In the following certain embodiments are described in greater detail with reference to the accompanying drawings, in which.

DETAILED DESCRIPTION OF PREFERRED EMBODIMENTS

In the present context, the term quadrilateral refers to a shape having four distinct sides connected successively to each other through connecting portions. The sides may be straight or exhibit chamfers, bends, kinks, etc. The connecting portions between sides may feature corners that may be angular, chamfered, rounded or otherwise shaped so as to introduce a change of orientation. In the illustrated example, the connecting portions are corners having a generally right angle.

In this context, the term diagonal refers to a direction having a vertical and a horizontal component. Diagonal members may connect a side frame section to a top section or a side frame section to a corner, two corners to each other or two lateral side frame sections to each other.

Figure 1:
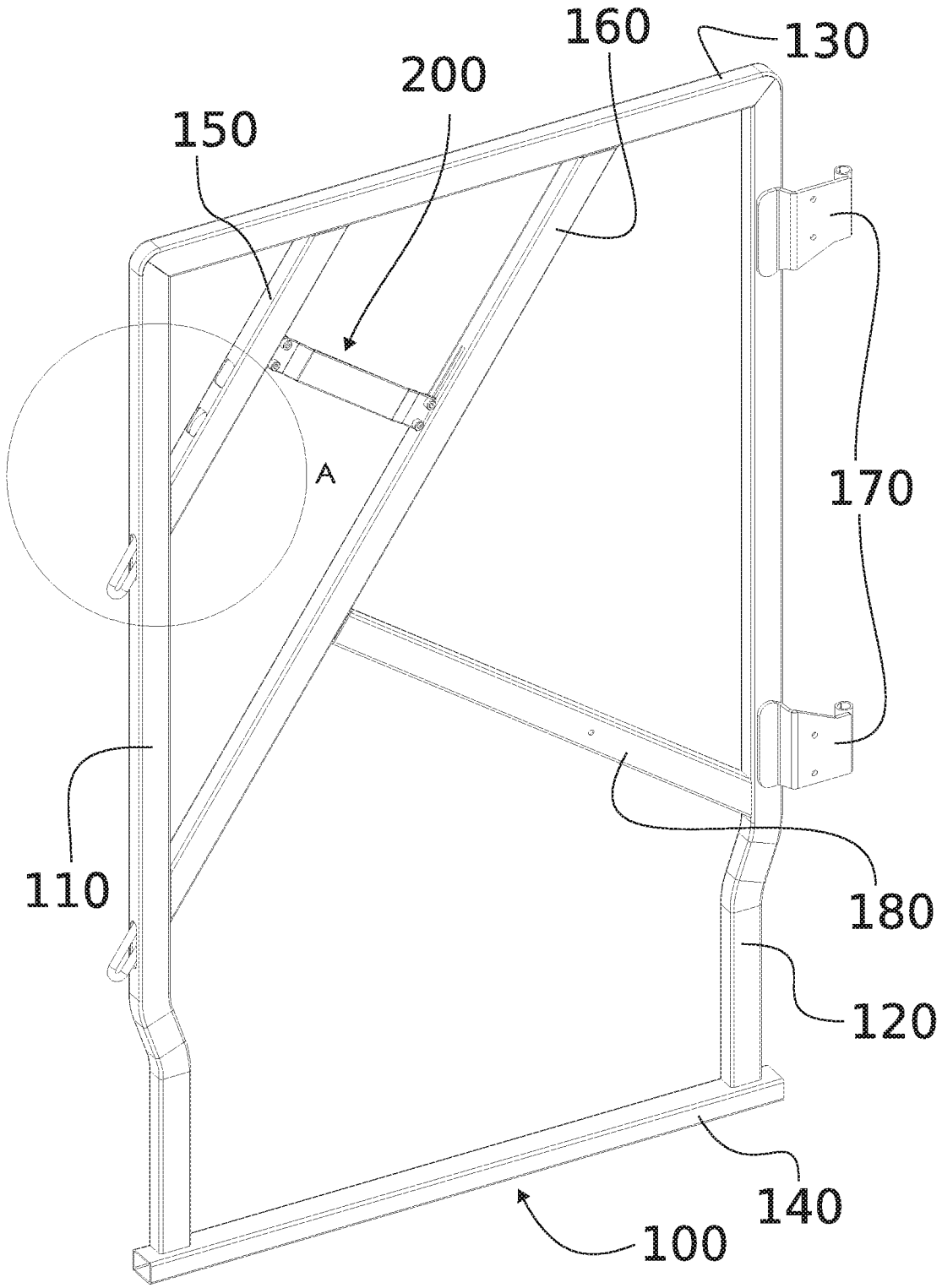
FIG. 1 illustrates a perspective view of a door in accordance with at least some embodiments of the present invention, wherein the latch of the door is in a locking state.

FIG. 1 shows a door 100 according to one particular embodiment particularly suitable for use in a logistics crate. The door 100 features a quadrilateral frame that has an inwardly chamfered bottom. More specifically, the door frame includes two parallel side frame sections, namely the first and second side frame section 110, 120, which extend in parallel and spaced apart. The purpose of the first side frame section 110 is to act as a far end of the door 100 so as to lock the door into the door jamb in a closed position. The purpose of the second side frame section 120 is to act as a pivot point. Accordingly, hinges 170 have been fitted to the second side frame section 120 for attachment to an opposing door jamb. The first and second side frame sections 110, 120 are connected at one end by a top frame section 130 and at the opposing end by a bottom frame section 140.

The door 100 is further fitted with a diagonal guide 150, 160 for providing a diagonal movement for a latch 200. More specifically, the purpose of the diagonal guide 150, 160 is to guide the latch 200 between the locking state and the released state by allowing deviation of the latch 200 along a path diagonal to the quadrilateral shape of the frame. By having a vertical component in the extending direction of the guide, gravity is utilized to bias the latch 200 towards the adjacent door jamb and ultimately towards the locking state. In the illustrated example the latch 200 includes two locking features, whereby the door 100 includes two corresponding diagonal guides 150, 160, namely a first guide 150 and a second guide 160, which extend between a first side frame section 110 and top frame section 130 of the door frame. The guides 150, 160 include an inner cavity to receive projections of the latch 200. It could also be possible to arrange the diagonal guides in another angle to extend between the side frame sections (not shown). However, the two locking features provide for a very sturdy connection between the door and an adjacent door jamb. A reinforcement 180 may be provided to connect the longer guide 160 to the adjacent side frame section.

Figure 2:
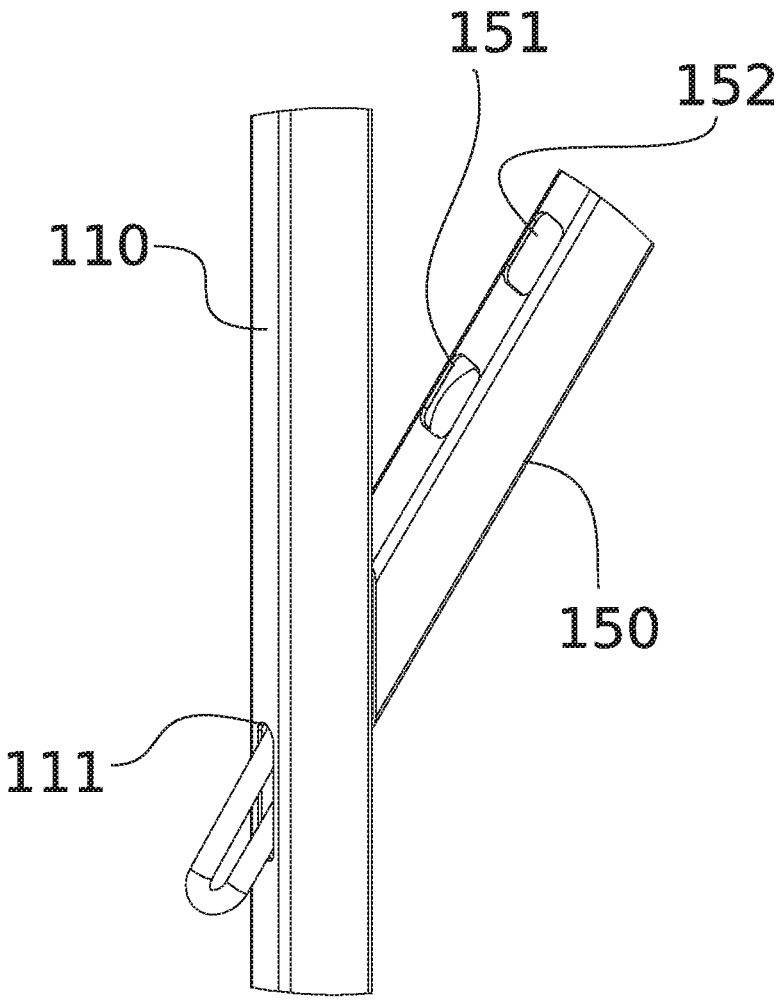
FIG. 2 illustrates a detail view of area A of FIG. 1.
Figure 5:
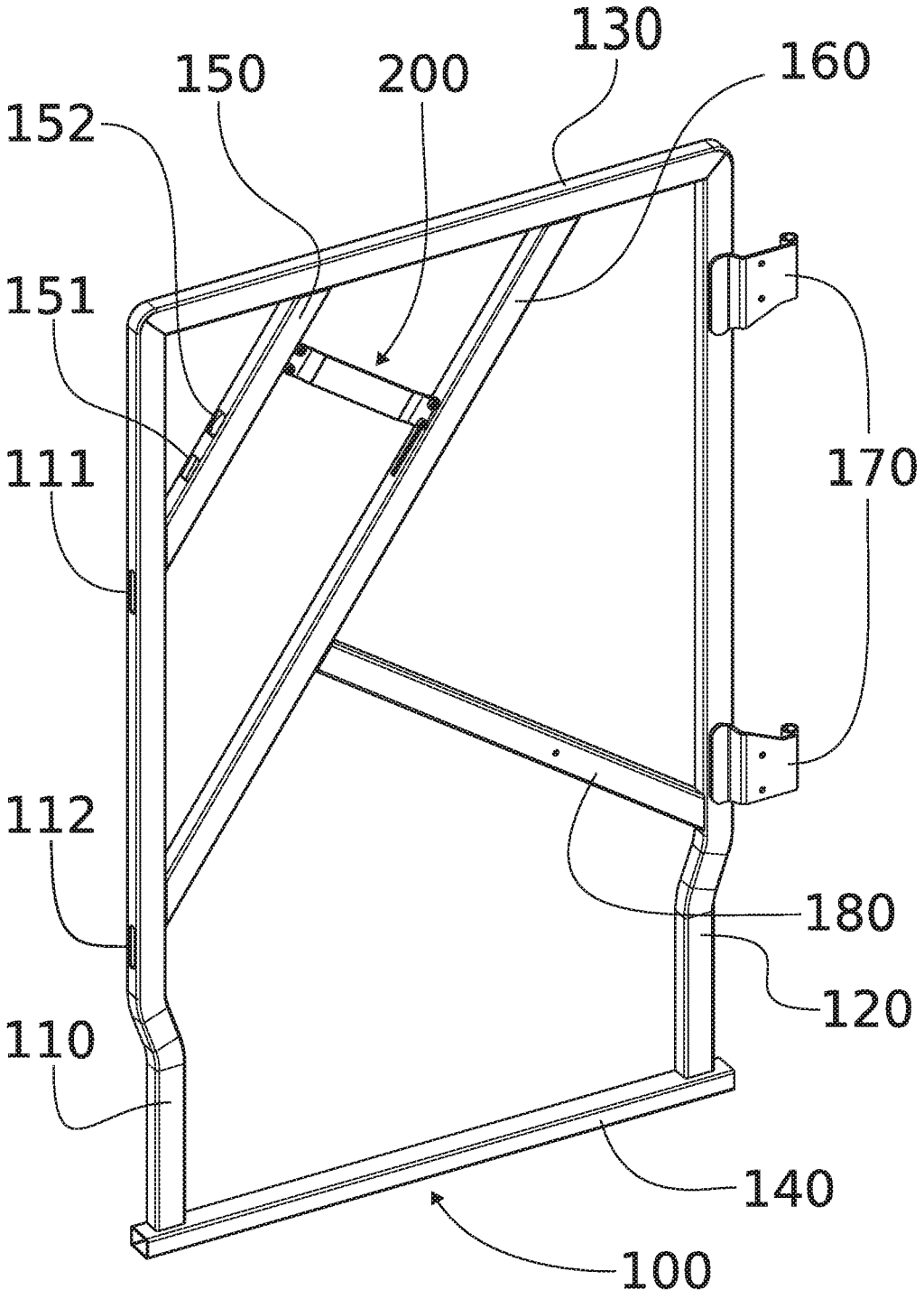
FIG. 5 illustrates a perspective view of the door of FIG. 1, wherein the latch of the door is in a released state.

The frame defines a perimeter for the door. The door also includes a latch 200, which is provided to the frame in a movable fashion so as to be toggled between a locking state and a released state. FIGS. 1 and 2 show the latch 200 in a locking state, in which the latch 200 protrudes outside the perimeter of the door 100. A first and a second opening 111, 112 have been provided to the first lateral frame section 110 of the door frame (FIG. 5). As can be seen, there is a portion of the door 100, which extends past the lateral outer surface of the door frame. In the released state shown in FIG. 5 the latch 200 is within the perimeter of the frame. The latch 200 according to the illustrated embodiment is constructed to feature two locking protrusions making contact with two corresponding opening is a receiving door jamb. It is, however, to be understood that the same principle will apply when using only one locking protrusion. The locking protrusions and the interaction thereof with the surrounding structure will be discussed in greater detail hereinafter.

Figure 3:
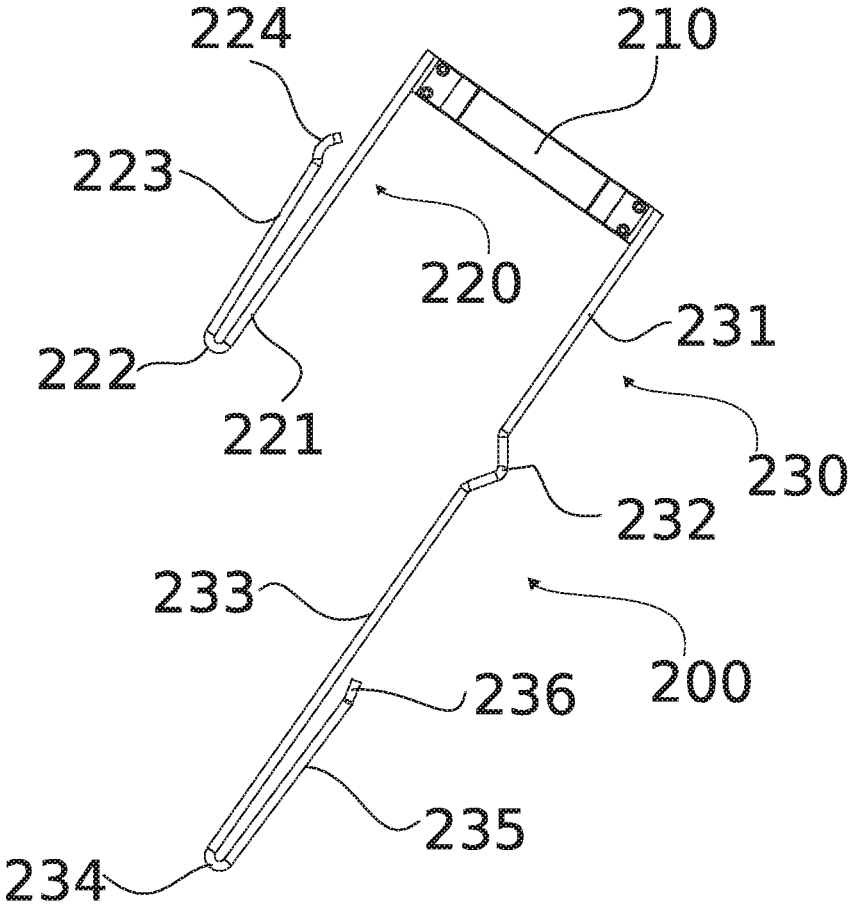
FIG. 3 illustrates a plan view of the latch of FIG. 1.

Next, however, let us study FIG. 3, which shows the structure of the latch 200 more clearly. The latch 200 has three major components, a handle 210 and two projections 220, 230 protruding from opposite ends of the handle in parallel. As mentioned above, the latch could also be constructed with only one locking feature (not shown), but at least two projections is possible. Accordingly, the first projection 220 may be constructed as an elastically deformable member configured to be compressed against a spring-back factor in a dimension perpendicular to the main extending dimension of the first projection 220. One way of establishing such a structure is to make the projections 220, 230 from a bent steel wire manufactured from a material with sufficient elastic properties. One example of such material is cold drawn steel wire, particularly C9D according to the (1.0304) EN 10016-2 standard. Such steel wire may have a tensile strength between 500 and 700 N/mm, particularly 525 and 675 N/mm. The steel wire components may be attached to the handle by screws, welding, etc. The first projection 220 includes a first wire section 221, which extends orthogonally to and from the handle 210. The first wire section 221 terminates to a distal portion 222, where the wire has a bend. A second wire section 223 extends from the distal section 222 in an angle defined by the bend. In the illustrated example the angle is close to 180 degrees. The second wire section 223 terminates to a holding protrusion 224. The holding protrusion 224 may be a simple bulge shaped into the wire. If the projection would be made from a profile or beam (not shown), the holding protrusion could be, for example, a protruding claw, button, etc. suspended to the profile or beam so as to be biased towards the extended position.

The second projection 230 of the latch 200 may have a similar structure to the first projection 220 in that it extends from the handle 210 and terminates to a distal portion 234, which includes a bend. Since the second projection 230 is relatively long, a crease 232 may be added between the first and second wire section 231, 233. The crease 232 increases the width of the projection and prevents buckling. A third wire section 235 extends from the distal portion 234 and terminates to an end 236. The end 236 may include a slight kink or bend so as to smoothen the end of the projection 230 for promoting fluent motion of the latch 200 in the guide 160 and for avoiding scraping of the latch 200 against the inner cavity wall.

Figure 4:
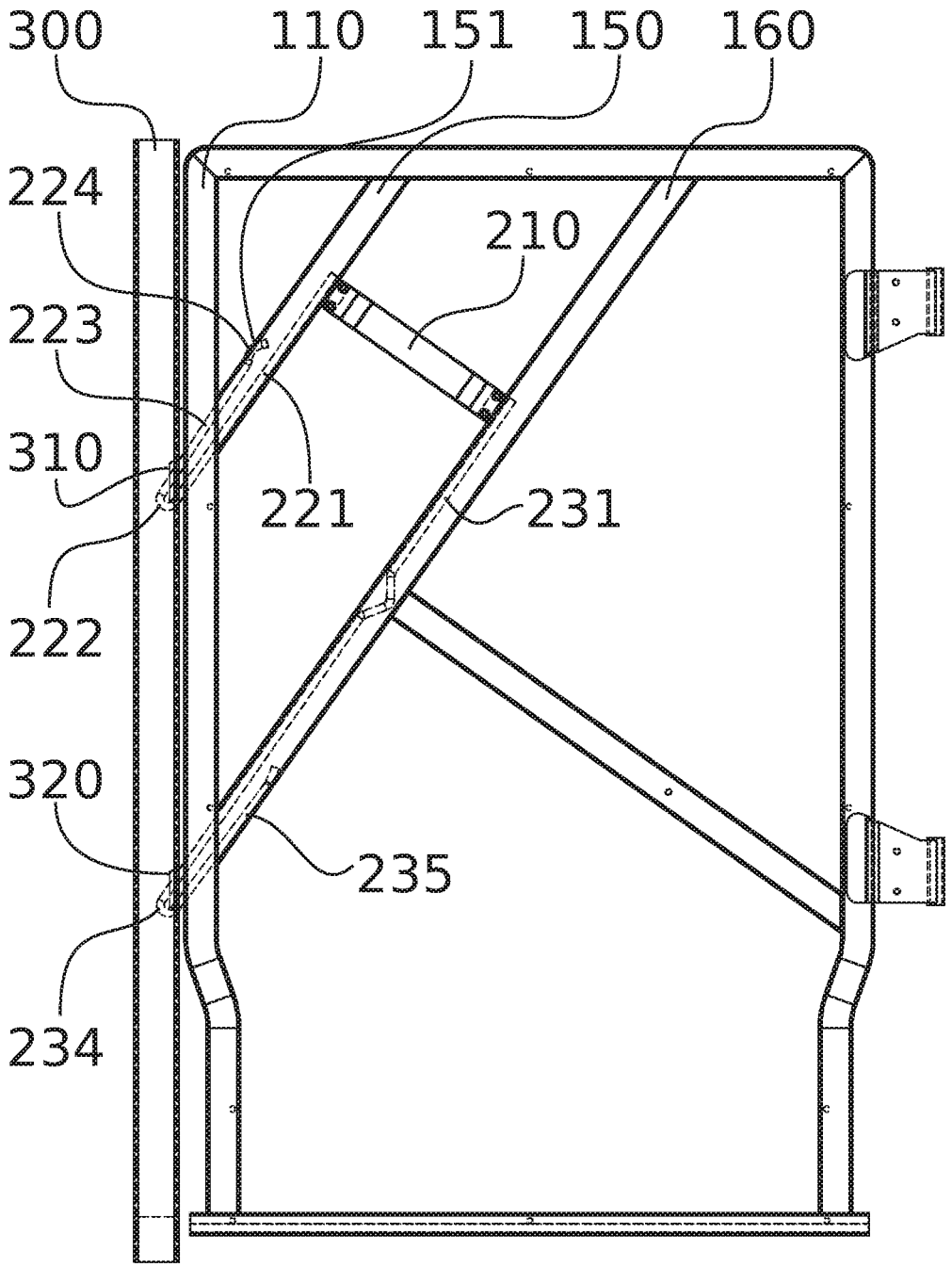
FIG. 4 illustrates a partial cut-out view of a closing system with the door of FIG. 1.

A speciality of the novel door 100 is a slanted feed action of the latch 200 provided for by the diagonal guides 150, 160. FIG. 4 shows how the first projection 220 extends in the inner cavity of the first guide 150 and how the second projection 230 extends in the inner cavity of the second guide 160. As shown in FIGS. 1, 2 and 4, the distal portions 222, 234 of the latch 200 protrude from inside the perimeter of the door frame in a diagonal angle to be received by catches 310, 320 provided to a door jamb 300 adjacent to the first side frame section 110 of the door 100. The catches 310, 320 may be superposed openings provided to the door jamb 300 and aligned with the distal ends 222, 234 of the latch 200.

As is also shown in FIGS. 2 and 4, the door 100 may feature a holding mechanism for holding the latch 200 in the released state or locking state or selectively both. As an example of such a holding mechanism, the first guide 150 may be provided with a first opening 151 and a second opening 152 for receiving the holding protrusion 224 of the first projection 220 of the latch 200 in two different states of the latch. The first opening 151 and the holding protrusion 224 are designed to cooperate such that the holding protrusion 224 may releasably engage the first opening 151, when the latch 200 is in the released state (FIG. 5). The second opening 152 and the holding protrusion 224, on the other hand, are designed to cooperate such that the holding protrusion 224 may releasably engage the second opening 152, when the latch 200 is in the locking state (FIGS. 2 and 4). To facilitate smooth movement in and out of the openings, the wire sections of the projections of the latch are configured to be resiliently deviated in a dimension perpendicular to the main extending dimension of the projection.

The holding protrusion 224 may exhibit a gradual protruding shape so as to ease the protrusion 224 in and out of the opening(s) in the first guide 150 during displacement of the first projection 220 along the inner cavity of the first guide 150. As mentioned above, the first projection 220 may be constructed as an elastically deformable member able to be compressed against a spring-back factor in a dimension perpendicular to the main extending dimension of the first projection 220. Accordingly, the holding protrusion 224 is resiliently suspended by the elastically deformable first projection 220. Alternatively, the holding protrusion may have a separate suspension, such as a spring biased button or similar.

Generally speaking the door 100 with the novel latch 200 forms a closing system including a first door jamb 300 with a catch 310 and a second door jamb 400 at a distance from the first door jamb 300. The first and second door jambs 300, 400 may be aligned so as to set up a frame work for the door 100. Accordingly, the door 100 extends between the first door jamb 300 and the second door jamb 400 in a closed state, whereas in the open state the door 100 extends in an angle in respect to the closed state. The second door jamb 400 provides a pivoting point for the door 100 and is attached thereto through the hinges 170. The first door jamb 300 provides a locking interface for the door 100. Accordingly, the first jamb 300 includes a catch for each locking feature of the door. In the illustrated example, the door 100 includes two locking features, namely the distal portions 222, 234 of the first and second projections 220, 230, respectively, whereby the first door jamb 300 includes two catches 310, 320, respectively. Accordingly, the distal portions 222, 234 of the projections 220, 230 of the latch 200 are configured to protrude into the second catches 310, 320 of the first door jamb 300, when the latch 200 is in the locking state, and to be outside the catches 310, 320 of the first door jamb 300, when the latch 200 is in the released state.

Figure 6:
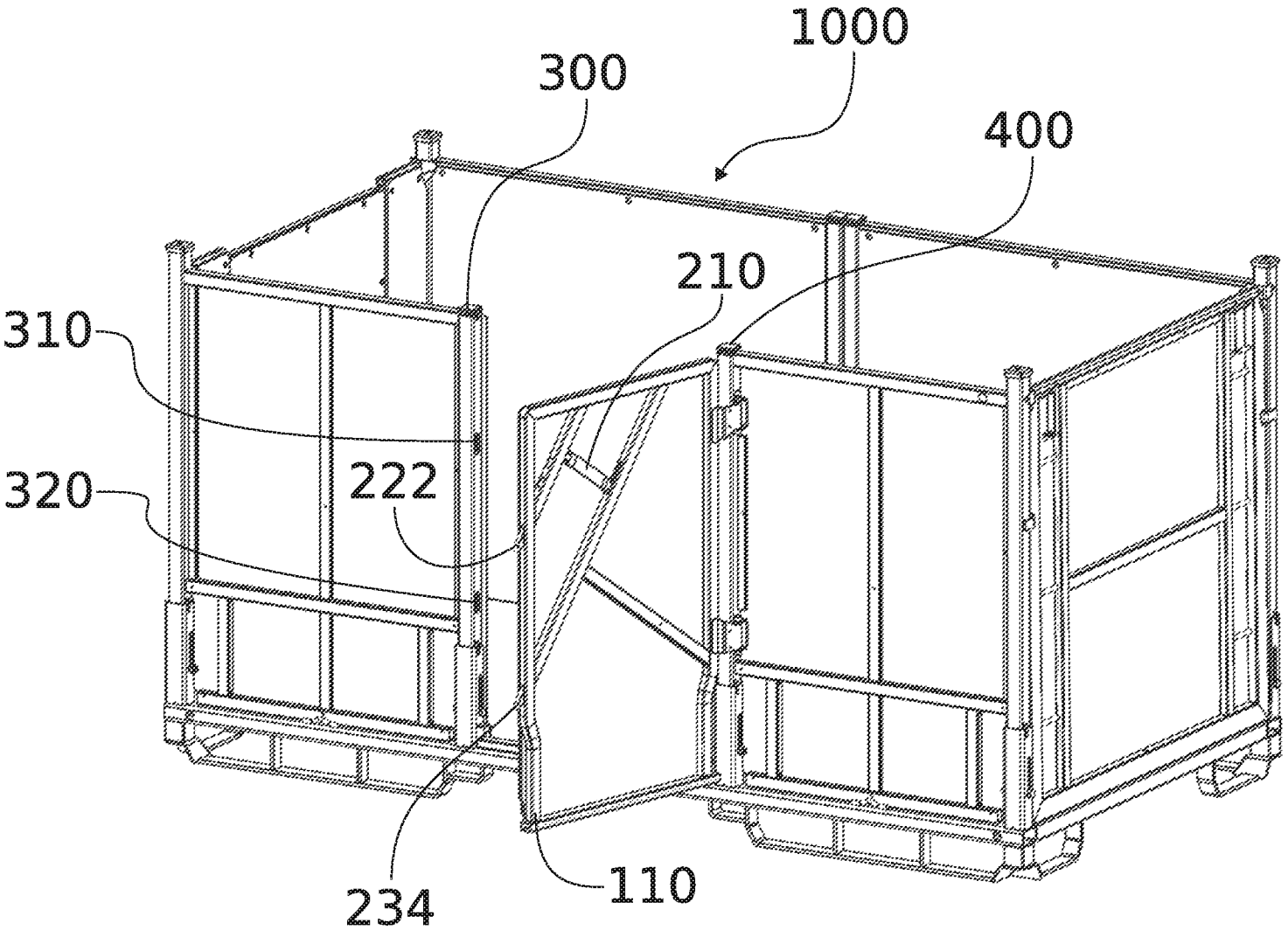
FIG. 6 illustrates the door of FIG. 1 in an opened state provided to a crate.

FIG. 6 shows the door 100 as part of a closing system provided to a logistics crate 1000. Here the first jamb 300 is a frame beam of a first side wall and the second door jamb 400 is a frame beam of a second side wall opposing the first side wall. Naturally, a similar construction could be used to provide several doors to such a container or to construct a door to a different container, such as a roll container, trailer, etc. Accordingly, one skilled in the art will foresee several applications for the novel solution.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In this description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A door comprising:

a quadrilateral frame defining a perimeter for the door and comprising a first diagonal guide which extends diagonally inside the perimeter of the door and which comprises an inner cavity, and a latch comprising a first projection and being provided movably into the inner cavity of the first diagonal guide of the frame, the projection extending along a main extending direction of the first diagonal guide, the latch being configured to be manipulated between:

a locking state, in which at least a distal portion of the latch protrudes outside said perimeter, and a released state, in which the distal portion is flush with or inside said perimeter, and wherein the first diagonal guide is configured to guide the latch between the locking state and the released state by allowing deviation of the latch along a path diagonal to the quadrilateral shape of the frame, wherein the door comprises a holding mechanism for holding the latch in at least one of the released state and the locking state, the holding mechanism comprising:

at least one opening provided to the first diagonal guide, and a holding protrusion provided to the first projection of the latch and configured to be resiliently deviated by the distal portion in a dimension perpendicular to the main extending dimension of the first projection so as to releasably engage each said at least one opening.

2. The door according to claim 1, wherein the latch has been fitted slidably to the first guide, which is bevelled to an angle enabling gravity to bias the latch towards the locking state.

3. The door according to claim 1, wherein the inner cavity of the first guide is aligned with a first opening provided to a first side frame section of the door frame allowing the first projection of the latch to slide through the side frame section between the locking state and the released state.

4. The door according to claim 1, wherein:

the holding mechanism comprises a second opening provided to the first guide, and wherein the holding protrusion is configured to releasably engage the second opening, when the latch is in the locking state.

5. The door according to claim 1, wherein the holding protrusion exhibits a gradual protruding shape so as to ease the protrusion in and out of the opening(s) in the first guide during displacement of the first projection along the inner cavity of the first guide.

6. The door according to claim 1, wherein the first projection is constructed as an elastically deformable member configured to be compressed against a spring-back factor in a dimension perpendicular to the main extending dimension of the first projection, whereby the holding protrusion is resiliently suspended by the elastically deformable first projection.

7. The door according to claim 1, including:

a handle extending from an opening through the first guide, and wherein the first projection is connected at one end to the handle and extends towards and terminates to a distal portion.

8. The door according to claim 7, wherein:

the door comprises second guide provided parallel to the first guide and comprising an inner cavity, and wherein the latch comprises a second projection attached to the handle at an end of the handle opposing the first projection, which second projection extends in the inner cavity of the second guide parallel to the first projection.

9. The door according to claim 8, wherein the inner cavity of the second guide is aligned with a second opening provided to a first side frame section of the door frame allowing the second projection of the latch to slide through the side frame section between the locking state and the released state.

10. A closing system comprising:

a first door jamb comprising a first catch, a second door jamb provided at a distance from the first door jamb, and a door, which:

is hinged to the second doorjamb so as to be turned between a closed state an open state, comprises a quadrilateral frame defining a perimeter for the door, the door frame comprising a first diagonal guide which is configured to guide the latch between the locking state and the released state by deviating the latch along a path diagonal to the quadrilateral shape of the frame, and which comprises a latch provided to the frame and configured to be manipulated between:

a locking state, in which at least a distal portion of the latch protrudes into the first catch of the first door jamb, and a released state, in which the distal portion is outside of the first catch of the first doorjamb, wherein the first diagonal guide is configured to guide the latch between the locking state and the released state by allowing deviation of the latch along a path diagonal to the quadrilateral shape of the frame, wherein the door comprises a holding mechanism for holding the latch in at least one of the released state and the locking state, the holding mechanism comprising:

at least one opening provided to the first diagonal guide, and a holding protrusion provided to the first projection of the latch and configured to be resiliently deviated by the distal portion in a dimension perpendicular to a main extending dimension of the first projection so as to releasably engage each said at least one opening, when the latch is in the released state.

11. The closing system according to claim 10, wherein:

a handle extends from an opening through the first guide, the first projection is connected at one end to the handle and extends towards and terminates to a distal portion, the door comprises second guide provided parallel to the first guide and comprising an inner cavity, the latch comprises a second projection attached to the handle at an end of the handle opposing the first projection, which second projection extends in the inner cavity of the second guide parallel to the first projection, the door jamb comprises a second catch, and wherein a distal portion of the second projection of the latch is configured to:

protrude into the second catch of the first door jamb, when the latch is in the locking state, and to be outside the second catch of the first door jamb, when the latch is in the released state.

12. A logistics container comprising a closing system which comprises:

a first door jamb comprising a first catch, a second door jamb provided at a distance from the first door jamb, and a door, which:

is hinged to the second doorjamb so as to be turned between a closed state and open state, comprises a quadrilateral frame defining a perimeter for the door, the door frame comprising a first diagonal guide, and in which a latch is provided to the quadrilateral frame is configured to be manipulated between:

a locking state, in which at least a distal portion of the latch protrudes into the first catch of the first door jamb, and a released state, in which the distal portion is outside of the first catch of the first doorjamb, wherein the first diagonal guide is configured to guide the latch between the locking state and the released state by allowing deviation of the latch along a path diagonal to the quadrilateral shape of the frame, wherein the door comprises a holding mechanism for holding the latch in at least one of the released state and the locking state, the holding mechanism comprising:

at least one opening provided to the first diagonal guide, and a holding protrusion provided to the first projection of the latch and configured to be resiliently deviated by the distal portion in a dimension perpendicular to a main extending dimension of the first projection so as to releasably engage each said at least one first opening and wherein the first jamb is a frame beam of a first side wall and wherein the second door jamb is a frame beam of second side wall opposing the first side wall.

13. The logistics container according to claim 12, wherein:

a handle extends from an opening through the first guide, the first projection is connected at one end to the handle and extends towards and terminates to a distal portion, the door comprises a second guide provided parallel to the first guide and comprising an inner cavity, the latch comprises a second projection attached to the handle at an end of the handle opposing the first projection, which second projection extends in the inner cavity of the second guide parallel to the first projection, the doorjamb comprises a second catch, and wherein a distal portion of the second projection of the latch is configured to:

protrude into the second catch of the first door jamb, when the latch is in the locking state, and to be outside the second catch of the first doorjamb, when the latch is in the released state.

* * * * *